United States Patent [19]

Thebaud et al.

[11] Patent Number: 4,835,029

[45] Date of Patent: May 30, 1989

[54] SHEATH STRUCTURE FOR FURNITURE, ENVELOPES, PANELING, AND THE LIKE

[76] Inventors: Sacha Thebaud; Francisco Thebaud, both of Castel Haiti, P.O. Box 446, Port-au-Prince, Haiti

[21] Appl. No.: 188,678

[22] Filed: Apr. 29, 1988

Related U.S. Application Data

[63] Continuation of Ser. No. 852,451, Apr. 3, 1986, abandoned.

[30] Foreign Application Priority Data

| | | | |
|---|---|---|---|
| Aug. 3, 1984 | [HT] | Haiti | 39-J |
| Nov. 14, 1984 | [HT] | Haiti | 40-J |
| Apr. 30, 1985 | [HT] | Haiti | 41-1 |
| Jul. 26, 1985 | [HT] | Haiti | 42-J |

[51] Int. Cl.[4] ..... A47C 7/02; A47C 20/00; B32B 1/04; B32B 1/08

[52] U.S. Cl. ..... 428/68; 5/432; 297/452; 297/453; 428/80; 428/81; 428/101; 428/102; 428/104; 428/122; 428/123; 428/126; 428/127; 428/129; 428/188

[58] Field of Search ..... 428/68, 80, 81, 83, 428/101, 102, 104, 121–129, 178, 188; 297/452, 453; 5/432

[56] References Cited

U.S. PATENT DOCUMENTS

| | | | |
|---|---|---|---|
| 1,583,300 | 5/1926 | McTernen | 297/452 |
| 1,587,705 | 6/1926 | Dozier | 297/452 |
| 1,587,706 | 6/1926 | Dozier | 297/452 |
| 4,278,288 | 7/1981 | Thebaud | 297/258 |
| 4,325,577 | 4/1982 | Thebaud | 297/45 |

*Primary Examiner*—William J. Van Balen

*Attorney, Agent, or Firm*—Foley & Lardner, Schwartz, Jeffery, Schwaab, Mack, Blumenthal & Evans

[57] ABSTRACT

A sheath structure (10) for use as a backrest for a chair or as a seat, envelope, wallet, purse, handbag, panel, etc., comprising pliable sheet material (32) stretched on a frame (20)and presenting spaced-apart front and rear exterior surfaces (33, 39). The frame is made up of at least two spaced-apart front and rear frame elements (26, 24), each corresponding to the front and rear exterior surfaces (33, 39). The frame elements define an intermediate space therebetween. The sheet material (32) forms the front and rear exterior surfaces (33, 39), extends over the frame elements (26, 24), and is tucked in within the intermediate space, and tension means, such as elastics (38), cooperate with respective tucked-in portions of the sheet material (32) so as to stretch the sheet material on the frame.

23 Claims, 23 Drawing Sheets

FIG.13
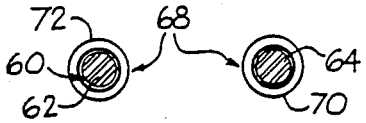
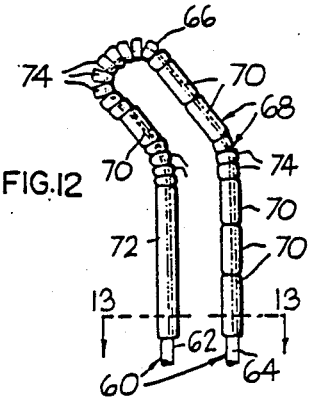
FIG.12
FIG.14
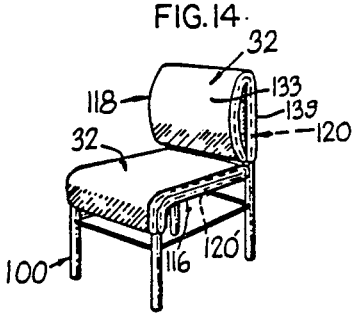
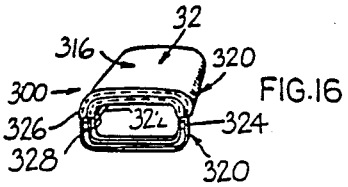
FIG.16
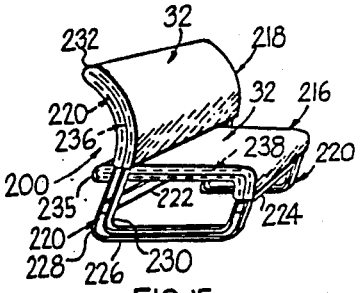
FIG.15
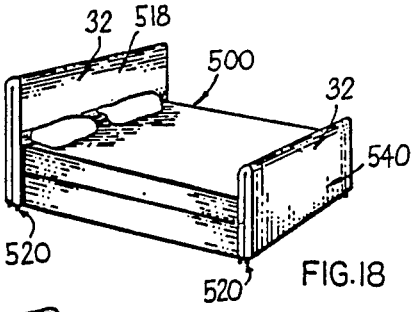
FIG.18
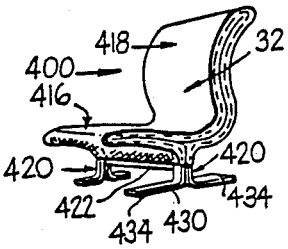
FIG.17

2
8
9
9

2
3
5
4
10

11
6

10
12

11
12
6
6
12
10
6
12

FIG.32
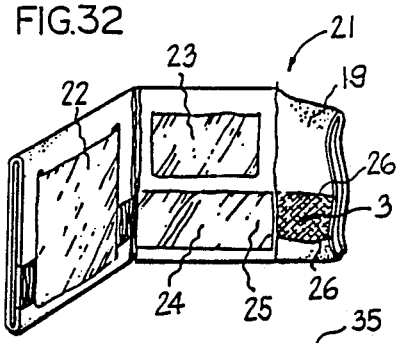
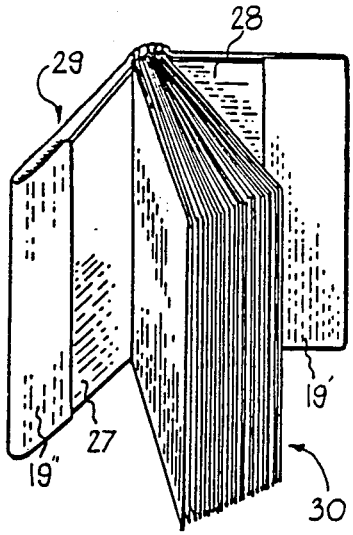
FIG.33
FIG.35
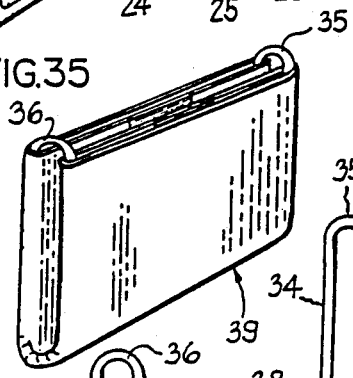
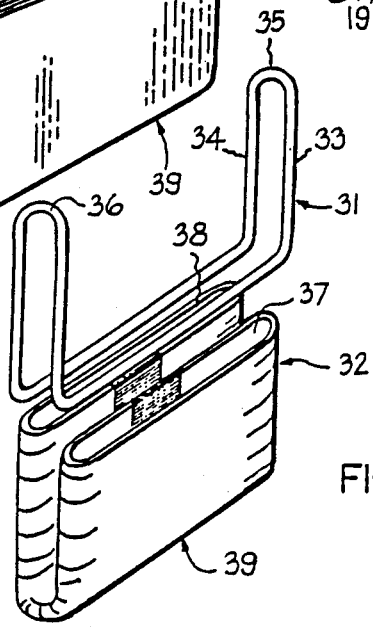
FIG.34

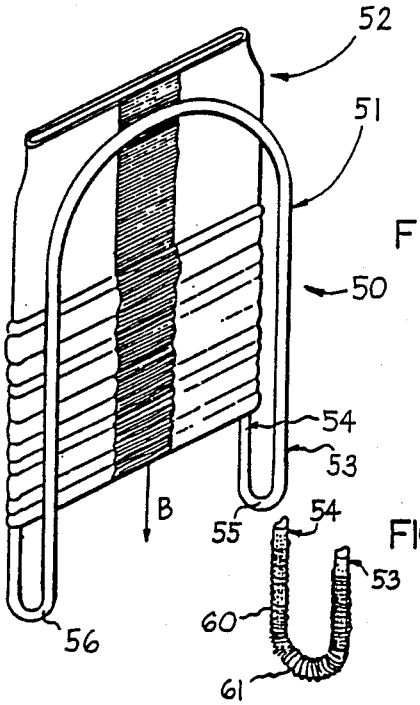
FIG.40
FIG.41
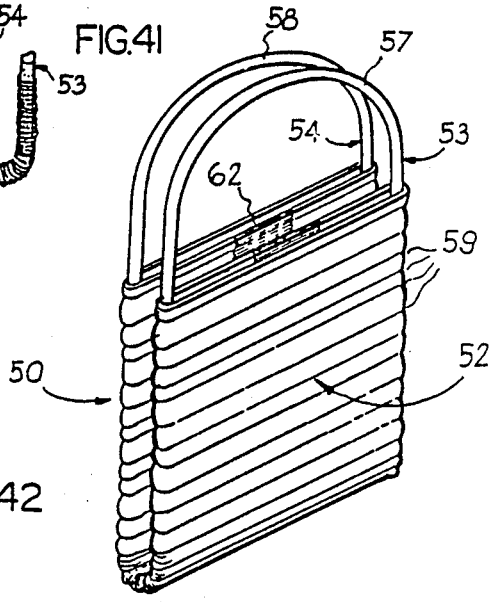
FIG.42

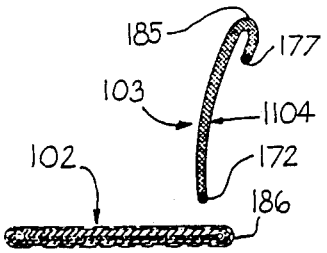
FIG.54
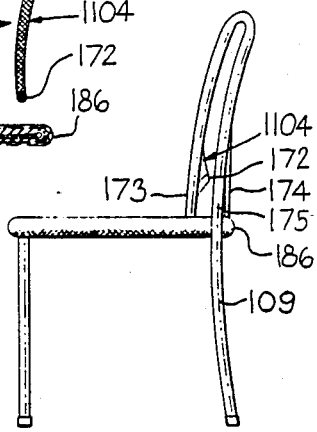
FIG.55
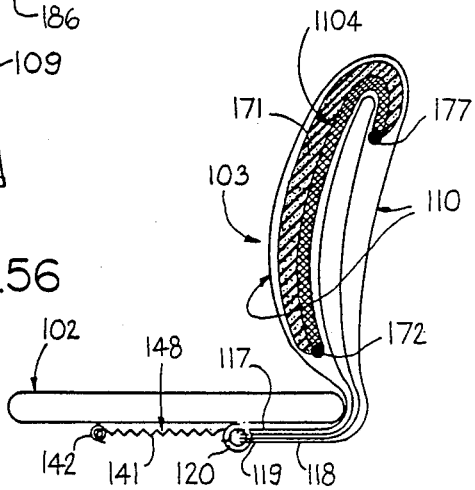
FIG.56
FIG.57
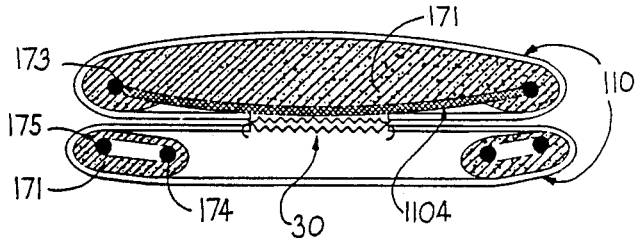
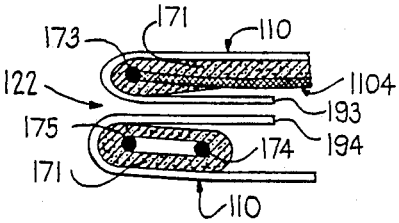
FIG.58

FIG.60
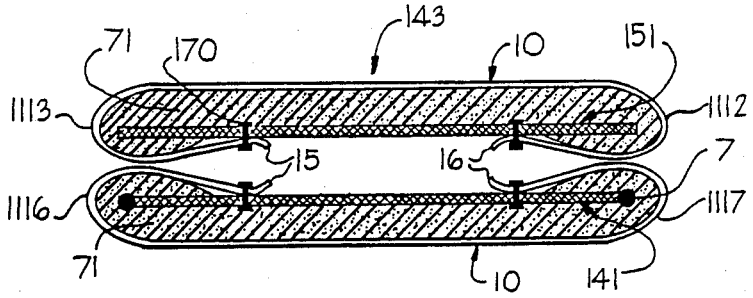
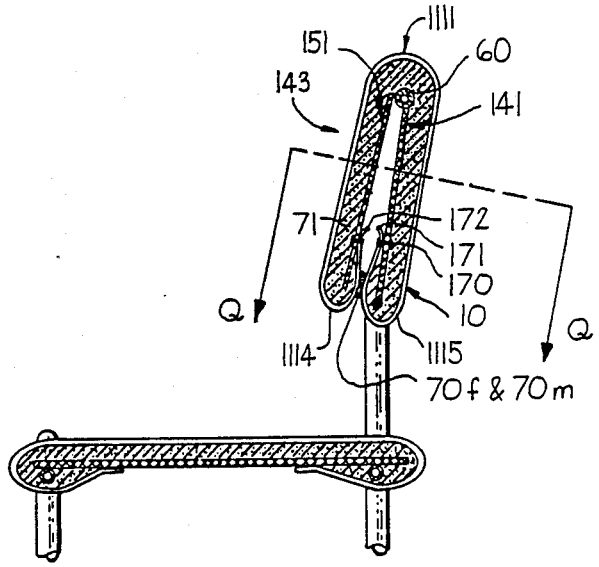
FIG.59

10
42
6
8
81
30
12
5
3
7
31
13
13'
14
20
16
41
15
21
33
34

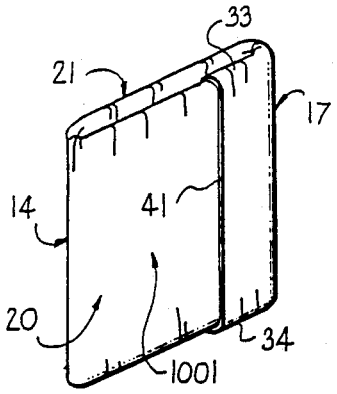
FIG.61e
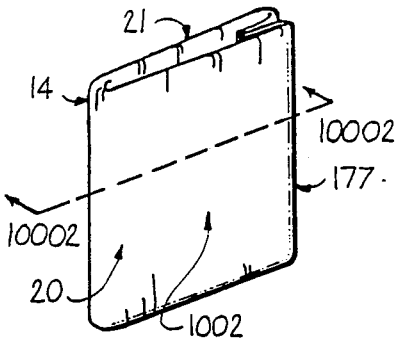
FIG.62
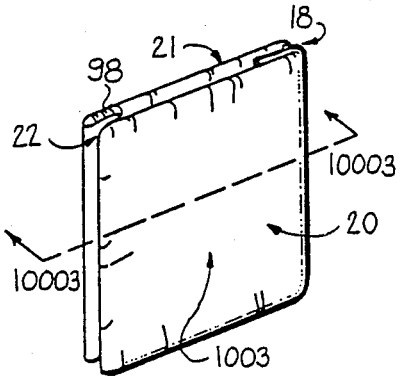
FIG.63
FIG.64a
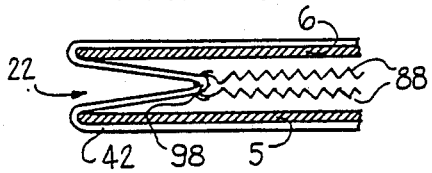
FIG.64b
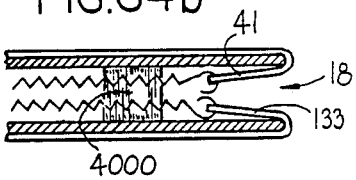
FIG.64c
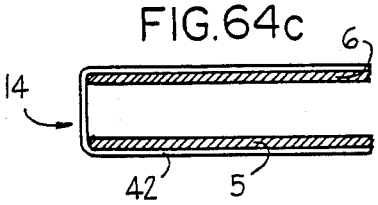
FIG.64d
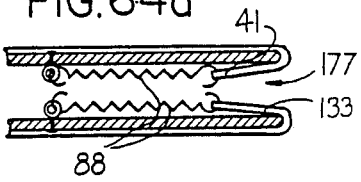

SHEATH STRUCTURE FOR FURNITURE, ENVELOPES, PANELING, AND THE LIKE

This application is a continuation of application Ser. No. 852,451, filed Apr. 3, 1986 now abandoned.

The present invention relates to a sheath structure, and more particularly, to a sheath structure in the form of upholstery for seating, envelopes, such as wallets, handbags, paneling for furniture or dividers, etc.

Sheath structure, in the present specification, means the combination of a pliable sheet material held under tension on a rigid frame.

It is known to provide furniture such as chairs, for example, with a back or a seat made of a single sheet of pliable material, such as fabric, leather, plastic, held under tension between spaced-apart frame members, the end edges of the upholstery material being folded over the frame members and attached together by laced strings or by springs. The strings or springs are apparent on the back of the chair or on the bottom of the seat, and the aesthetic of the chair leaves something to be desired.

Various types of envelope structures, such as wallets, briefcases, etc., are provided with stretchable interior pockets for the purpose of expansion when coins or other objects are accumulated in these pockets. These expandable pockets include a stretchable wall, usually in the form of an add-on to the material forming the envelope, thus requiring additional steps in manufacturing the item.

It is an aim of the present invention to provide a sheath structure which can be used as an improved upholstery structure for furniture.

The present invention provides a simple upholstery system for chairs, stools, sofas, beds and the like, wherein the upholstery material is held under tension, thus providing a soft and supple support surface, and wherein the attachment means holding the upholstery material attached to frame members is completely hidden from view.

The present invention provides a progressive body support system for a chair seat, back armrest and the like, which is of simple construction, which is easily removable and replaceable, which is neat and elegant in appearance, which does not reveal the suspension and attachment structure of a single sheet of upholstery material, which provides well ventilated chair seats and backs, and which, furthermore, has applications to foldable chairs.

It is also an aim of the present invention to provide a sheath structure in accordance with the present invention which can be applied to envelopes, such as to be used in the manufacture of bags, satchels, various cases, purses, wallets, wherein expandable pockets are provided, and utilizing a minimum number of seams and parts.

It is also an aim of the present invention to provide a sheath structure which can be utilized for covering parts of furniture, such as a table base, or for forming panels, such as dividers, of the type presently used in offices.

A construction in accordance with the present invention comprises a sheath structure including pliable sheet material stretched on a frame and presenting spaced-apart front and rear extension surfaces, the frame being made up of at least two spaced-apart generally co-extensive elements each extending parallel to the front and rear exterior surfaces respectively, the frame elements defining an intermediate space therebetween, the sheet material forming the front and rear exterior surfaces extending smoothly over the frame members and being tucked in within the intermediate space, and tension members within the intermediate space extending to the tucked-in portions of the sheet material so as to stretch the sheet material on the frame, and the spacing of the frame elements defining the intermediate space being such that the tension members are generally hidden from view.

In a more specific embodiment, the frame elements may be in the form of spaced-apart U-shaped members forming the edges of the parallel frame elements, or the frame elements may be in the form of rigid plates co-extending with each other and in close proximity thereof defining an intermediate space therebetween and providing side edges over which the sheet material is extended.

In the case of an envelope for use as a bag or other, an extensible flexible sheet material passes over a double frame, the sheet material being in the form of a sleeve with the seam representing the tension members extending within the intermediate space hidden from view. The pockets may be on the inside of the frame, that is, within the intermediate space. The frame members may be hinged or rigidly connected together.

When the invention is applied to furniture construction, such as a backrest of a chair, the double frames are as close together as possible.

Having thus generally described the nature of the invention, reference will now be made to the accompanying drawings, showing by way of illustration, a preferred embodiment thereof, and in which:

FIG. 12 is a schematic view of a modified frame structure according to the present invention;

FIG. 13 is a sectional view from line 13—13 of FIG. 12;

FIGS. 14 to 21 are examples of furniture constructed according to the present invention;

Figure 4:
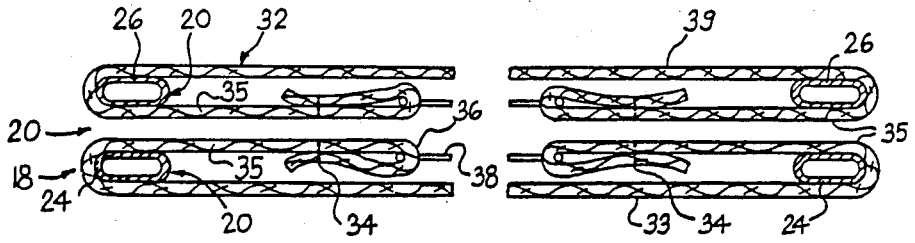
FIG. 4 is a schematic transverse section along line 4—4 of FIG. 2.
Figure 25B:
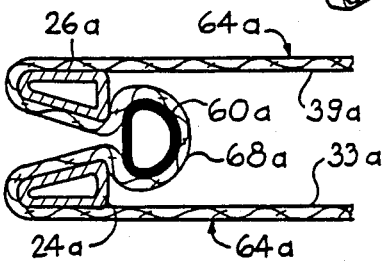
Figure 25A:
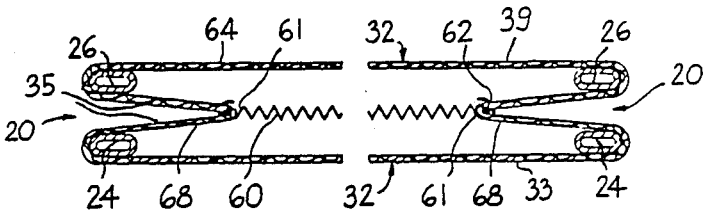

FIGS. 25*a* and 25*b* are views similar to FIG. 4, but showing modifications thereof;

FIGS. 26*a* through 26*g* are perspective views showing a step-by-step manner in which an envelope, such as a wallet, is formed in accordance with the present invention;

FIGS. 27 through 31 are side elevations of an envelope formed according to FIGS. 26, etc.

Figure 44:
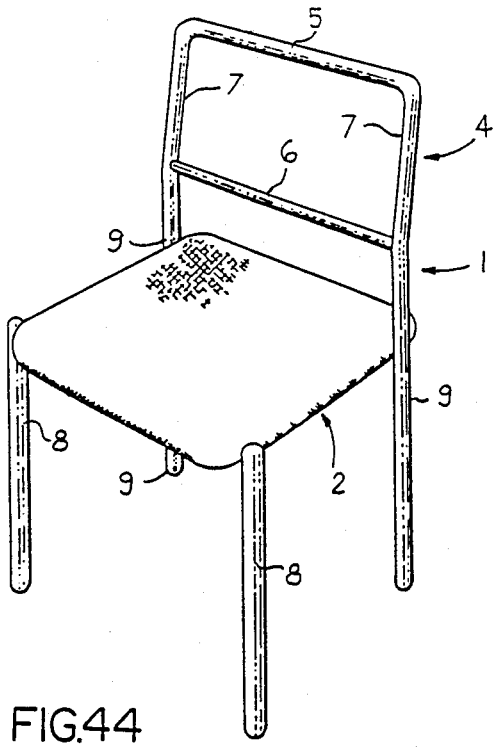
Figure 43:
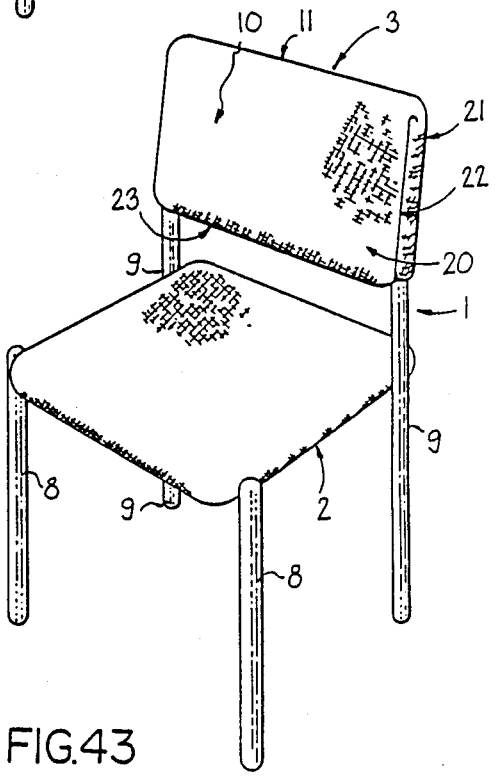
Figure 45:
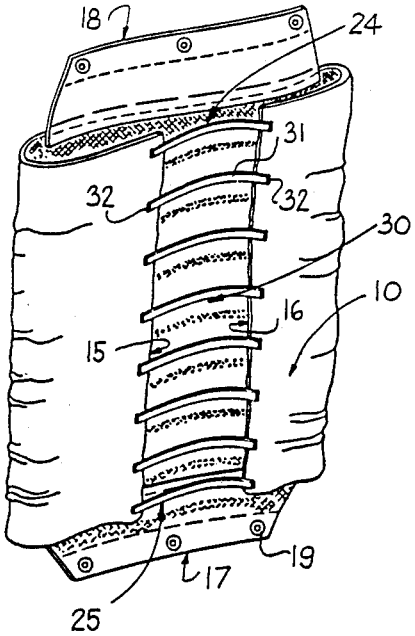
Figure 46A:
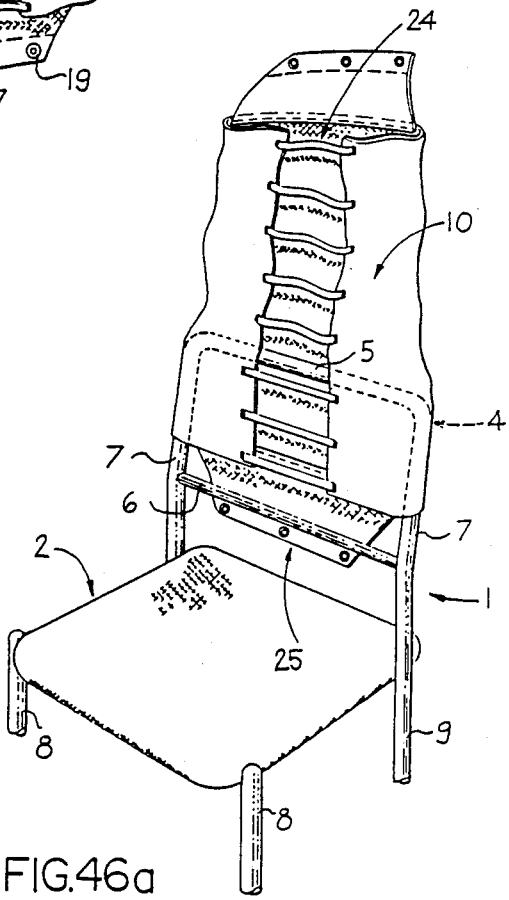
Figure 46B:
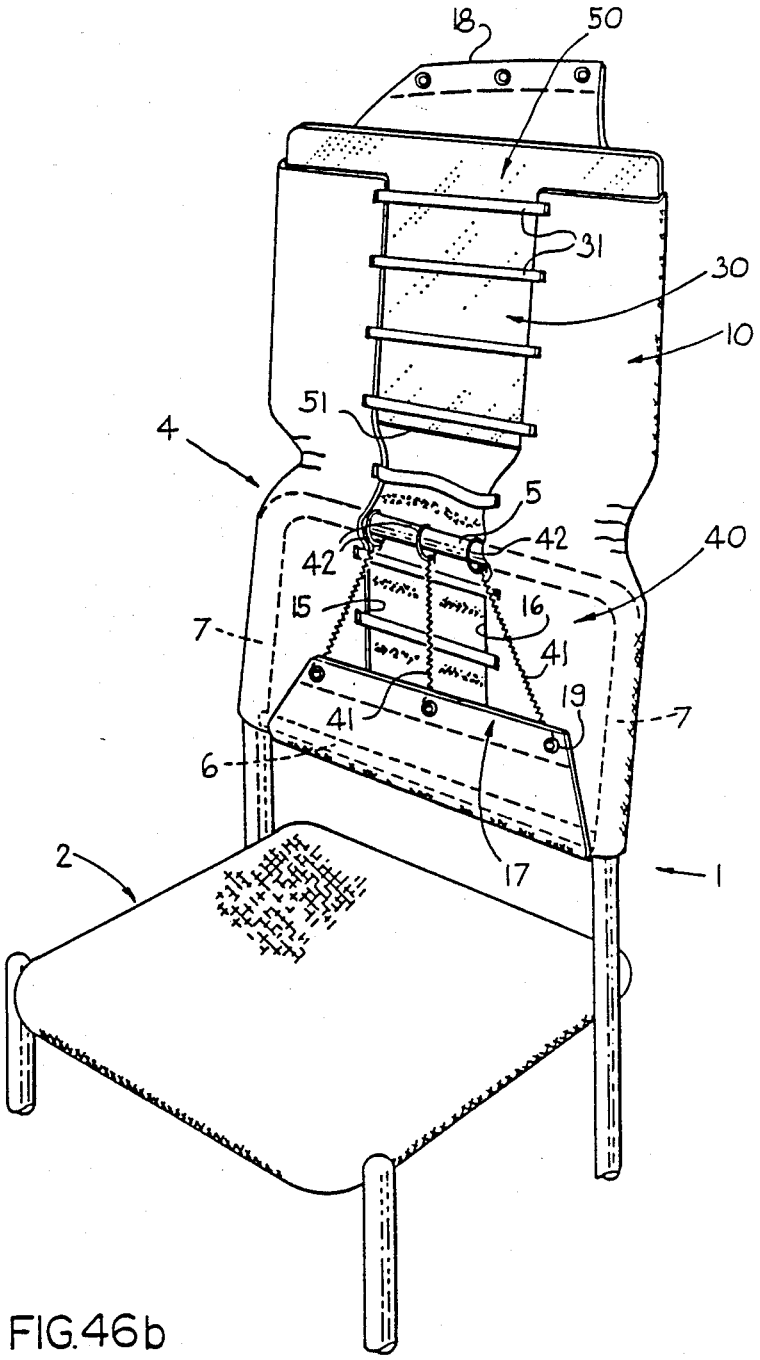
Figure 46C:
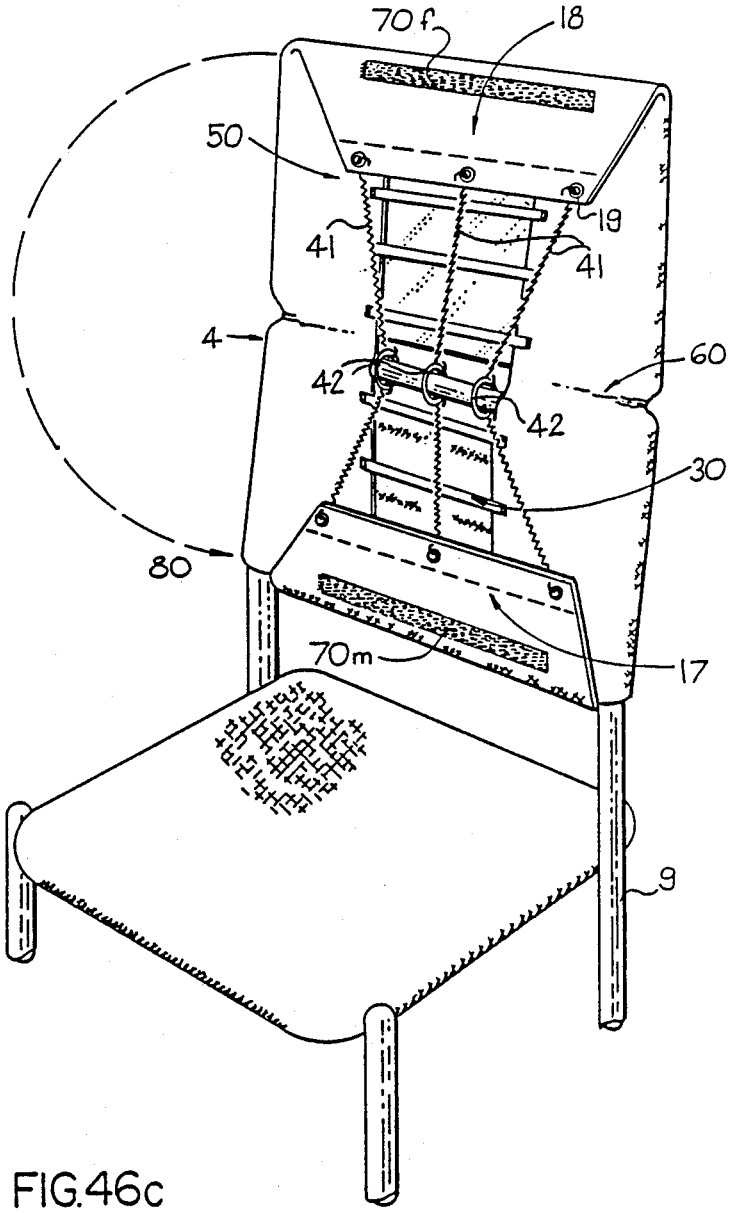
Figure 47:
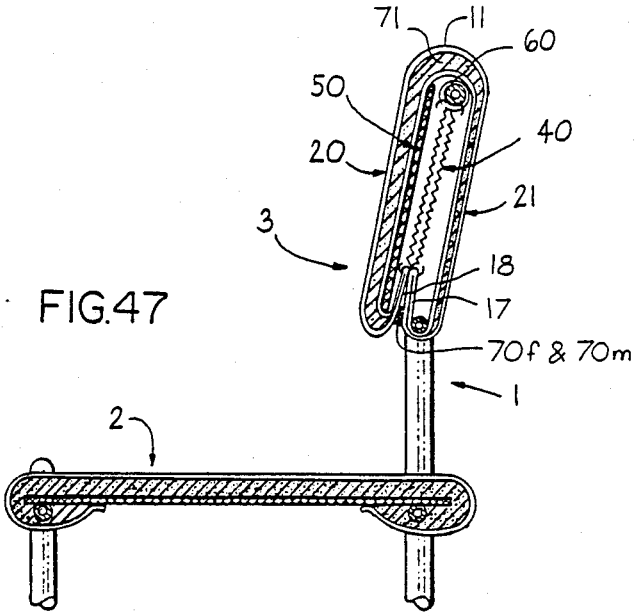
Figure 48:
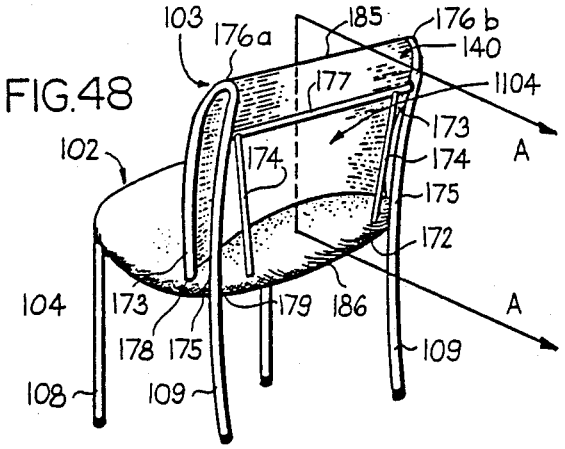
Figure 49:
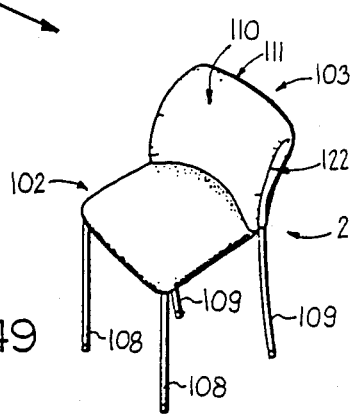
Figure 50:
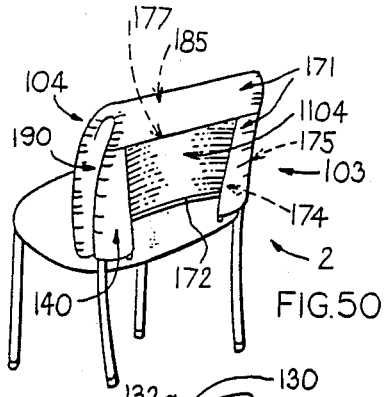
Figure 65:
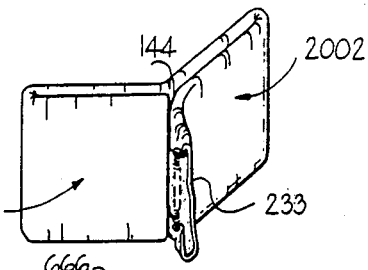
Figure 66:
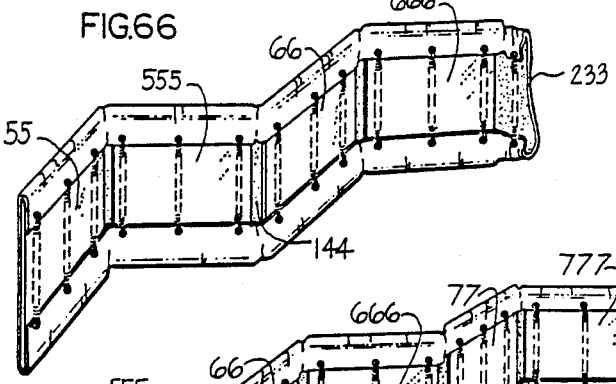
Figure 67:
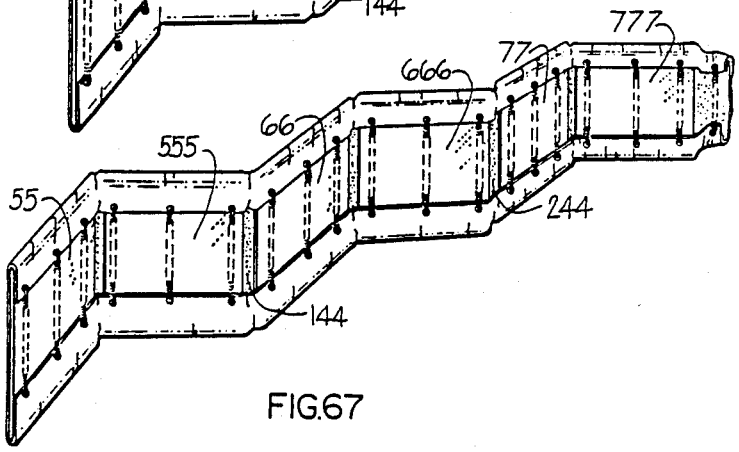
Figure 68:
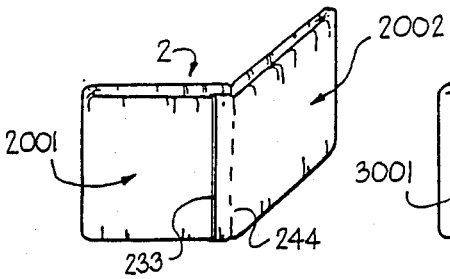
Figure 69:
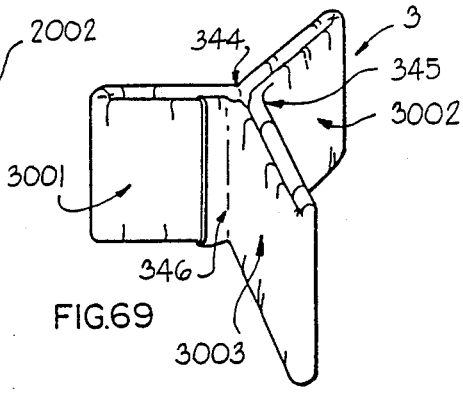
Figure 70:
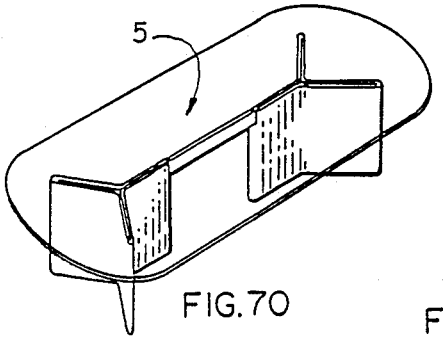
Figure 71:
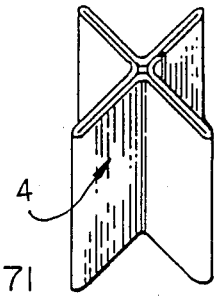

FIG. 32 is a perspective view of a wallet formed in accordance with the present invention;

FIG. 33 is a perspective view showing a book cover utilizing the present invention;

FIGS. 34 through 39 show different stages in the formation of an envelope with a cover which is another embodiment in accordance with the present invention;

FIGS. 40 through 42 show the formation of a carrying bag in accordance with the present invention;

FIG. 43 is a perspective view of a chair showing yet another embodiment of the present invention;

FIG. 44 is a perspective view of the chair shown in FIG. 43 but with the sheath removed from the backrest frame;

FIG. 45 is a perspective view of the sheath disassembled from the backrest frame in FIG. 43;

FIGS. 46*a* through 46*c* are fragmentary perspective views showing the installation of the sheath on the backrest frame in accordance with the embodiment shown in FIGS. 43 and 44;

FIG. 47 is a fragmentary vertical cross-section of the chair shown in FIG. 43;

FIG. 48 is a perspective view taken from the rear of another embodiment of the present invention;

FIG. 49 is a perspective view taken from the front of the embodiment shown in FIG. 48;

FIGS. 50 through 53 are perspective views taken from the rear of the chair shown in FIG. 48, but showing different phases of the installation of a backrest for a chair in accordance with the present invention;

FIG. 54 is a vertical cross-section of certain details of the chair shown in FIGS. 48 through 53;

FIG. 55 is a side elevation of the chair;

FIG. 56 is a vertical cross-section showing a further detail of the embodiment shown in FIGS. 48 through 53;

FIG. 57 is a horizontal cross-section taken through the backrest of the chair shown in FIG. 48;

FIG. 58 is a fragmentary horizontal cross-section showing a different embodiment of the sheath shown in FIG. 57;

FIG. 59 is a fragmentary vertical cross-section showing yet another embodiment of the present invention;

FIG. 60 is a section taken along line O—O of FIG. 59;

FIGS. 61*a* through 61*e* each show another application of the present invention in different phases of assembly, the application being related to a panel;

FIGS. 62 and 63 are perspective views of the panel with different embodiments of the present invention;

FIGS. 64*a* through 64*d* are fragmentary horizontal cross-sections taken through a panel showing different attachments which can be used;

FIG. 65 is a screen formed of the panels made in accordance with the present invention;

FIGS. 66 and 67 are perspective views showing different panels in a preassembled phase;

FIGS. 68 and 69 are perspective views of the assembled panels according to FIGS. 66 and 67; and FIGS. 70 and 71 show further applications of panels formed in accordance with the present invention.

Figure 1:
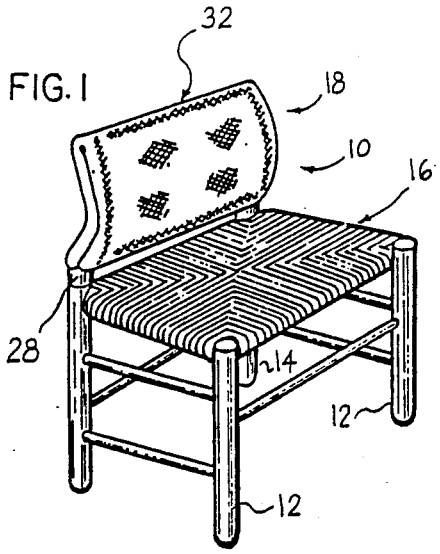
FIG. 1 is a perspective view of a chair having a back structure according to the present invention.
Figure 2:
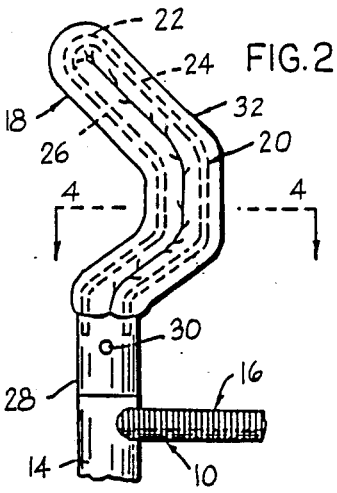
FIG. 2 is a partial side elevation view thereof.
Figure 3:
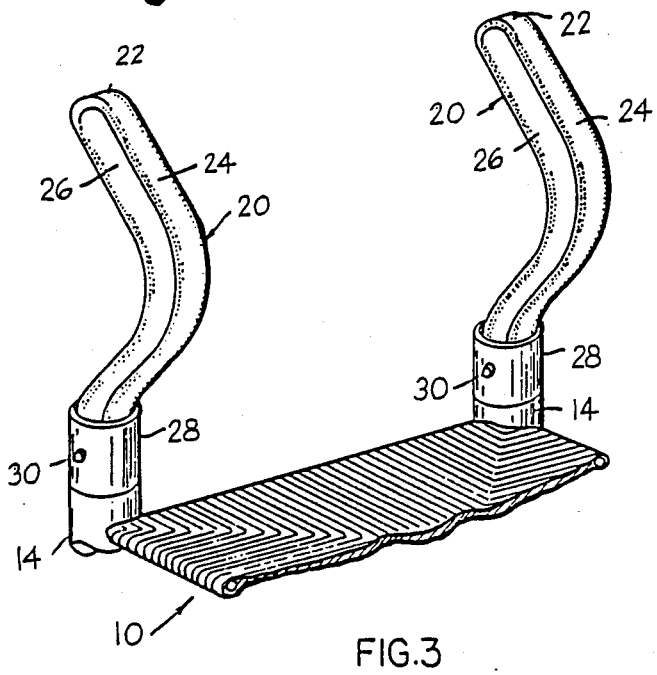
FIG. 3 is a partial perspective view of the chair of FIGS. 1 and 2 with the back upholstery removed.

Referring to the drawings and more particularly to FIGS. 1 and 2, a chair 10 is illustrated which consists of a pair of front legs 12 and a pair of rear legs 14 supporting a rush bottom seat 16, for example. A backrest 18 is affixed to the top of the rear legs 14. In the example of structure illustrated, the back 18 is upholstered and is supported by a pair of spaced-apart substantially parallel upright posts 20 (FIGS. 2 and 3). Each back supporting upright post 20 takes the form of a generally U-shaped bifurcated member consisting of a length of rod or tube bent over as shown at 22 such as to form a pair of legs 24 and 26 disposed substantially parallel to each other and which may be straight or bent, as shown in the drawing, to any appropriate shape. The free ends of the two parallel legs or branches 24 and 26 are joined together by a tubular fitting 28, to which there is welded, soldered, or otherwise fastened, each tubular fitting 28 being in turn pressed over the free end of one of the chair rear legs 14, at the top thereof, and held in position by any convenient means such as, for example, a transversely fastened screw or pin 30. In the example of structure illustrated, and as more clearly shown in FIG. 4, the back support upright posts 20 are made of a length of bent-over rigid flat tubing, although it will be appreciated that round tubing or round or flat rod material, preferably metallic, but also made of strong, preferably reinforced, plastic may be used.

The seat back 18 is made of a length of upholstery sheet material 32 (FIGS. 1 and 2 and 4 to 8) which may be any convenient supple, pliable sheet material, such as leather, fabric, canvas, plastic fibers, plastic film, or the like. The upholstery sheet material 32 is highly pliable, and it may be elastic or it may be non-elastic. In the example of structure illustrated in FIG. 4, the upholstery sheet material 32 is disposed stretched over the front of the upright post front legs or branches 24 as shown at 33, folded around the side of the legs or branches 24 and stretched over the back of the legs or branches 24, as shown at 35, the edges of the sheet of upholstery material 32 being sewn as shown at 34 for forming a hem 36, the two opposed spaced-apart hems 36, being interconnected by means of tension members taking the form, for example, of a string 38 which is laced through apertures through the upholstery material 32 at the edge of the hems 36. The string 38 may be in the form of a thin rope which is laced through the hems by means of a curved needle, or it may be made of elastic stretchable material, highly tensioned, if so desired. Similarly, the sheet of upholstery material 32 is stretched over the back of the upright post rear legs or branches 26 as shown at 39, wrapped around the sides of the legs or branches 26 and edges forming the hems 36 are joined by the tension member 38. In this manner, the connection between the hems 36 of the sheet of upholstery material 32 are hidden from sight, and it is readily apparent that a load applied against the face 33 of the sheet of upholstery material 32 is elastically absorbed by the material itself along its front face 33 and further absorbed, if and when the load is increased, by the rear portion 35, when the front portion 33 engages the rear portion 35 through the double-up edge portion forming the hem 36, some of the load being also absorbed by the tension members 38. Extremely heavy loads, causing further tension of the front face 33, rear portion 35 thereof causes engagement with adjoining rear portion 35 of the rear stretched portion 39 of the upholstery material, and so on and so foth as the load increases. It can thus be seen that loads applied to the back 18 of the seat are absorbed in sequence and in increased amount of resistance by actually four layers of upholstery material 32, each layer being spaced-apart from the subsequent layer.

Figure 5:
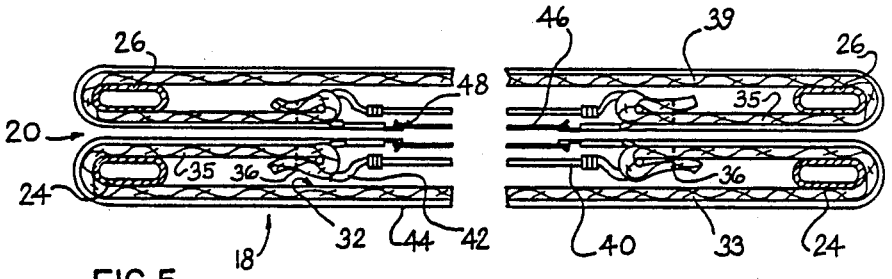
FIGS. 5 to 8 are views similar to FIG. 4, but showing modifications thereof.

FIG. 5 illustrates a modification wherein the upholstery material 32 is made of substantially non-stretchable material. The edges of the back portion 35 of the sheet of upholstery material, provided with the hems 36, are interconnected by means of tension members taking the form of elastic straps 40 having a hook 42 attached at each end, the hooks 42 being hooked through the hems 36. The sheet of upholstery material 32 is, in the structure of FIG. 5, provided with a protective layer of seat cover material 44, the edge of the seat cover material 44 being interconnected in the back and out of sight, by means of stretchable tension strands 46 also provided at each end with a hook 48 through the edge of the sheet of seat cover material 44.

Figure 6:
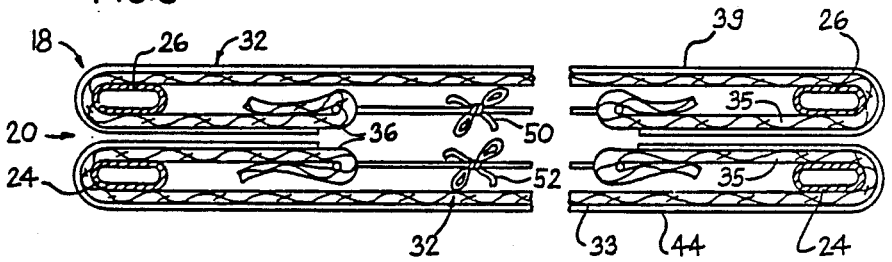

As shown at FIG. 6, the tension members may take the form of single length or loop 50 of string or leather, threaded or laced through the edge of the hems 36 of the length of upholstery material 32, the ends of the string or loop being tied by a knot 52. Using a sheet of upholstery material 32 which is non-stretchable, the lengths or loops of string or leather 50 are conveniently made of stretchable material while, if the upholstery material is stretchable, the tension members consisting of the attaching lengths of string 50 are conveniently made of non-elastic non-stretchable material, such as to apply an approporiate tension or pull upon the hemmed edges of the upholstery material. In the structure of FIG. 6, the upholstery material 32 is covered by a layer of seat cover material 44, the ends of which are interconnected by any appropriate means, not shown, such as for example, the elastic tension members 46 of FIG. 5, provided at each end with a hook 48, or simply by lacing with a thread.

Figure 7:
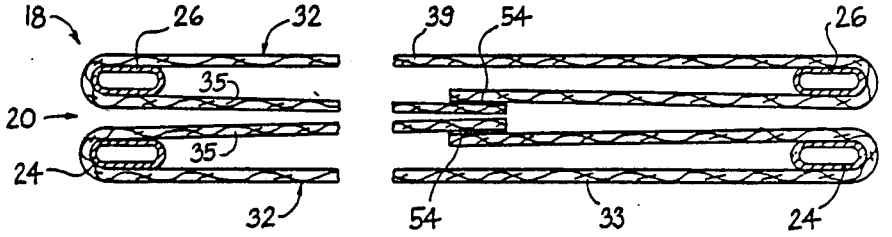
Figure 8:
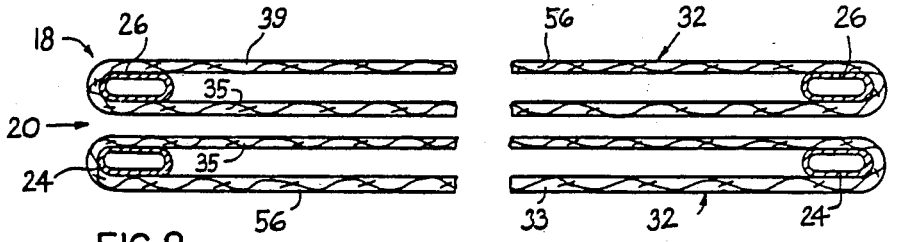

FIG. 7 illustrates an alternative structure wherein the edges of the sheet of upholstery material 32, where interconnected out of sight in the space between the front stretched portion 33 and the rear stretched portion 39, are each provided with a band of complementary hook and loop material, sometimes referred to as Velco-type material, as shown at 54. FIG. 8 illustrates a simple form consisting of a single sleeve 56 of upholstery material 32, preferably of the stretchable type, which is fitted over the front legs or branches 24 and rear legs or branches 26 of the upright post members 20.

Figure 9:
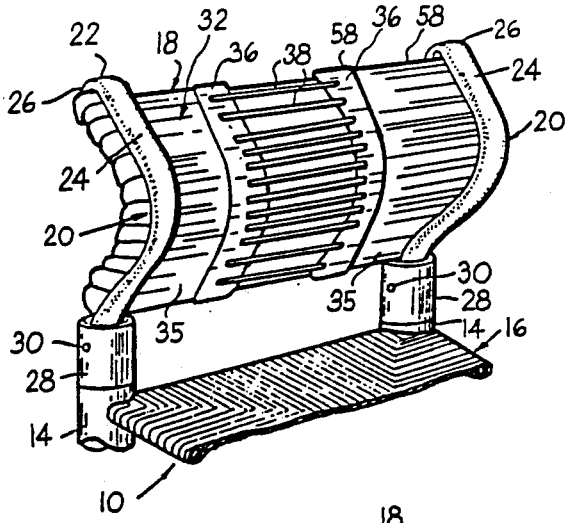
FIGS. 9 to 11 are partial perspective views of the chair of FIG. 1 illustrating the manner in which the seat back upholstery is installed.
Figure 10:
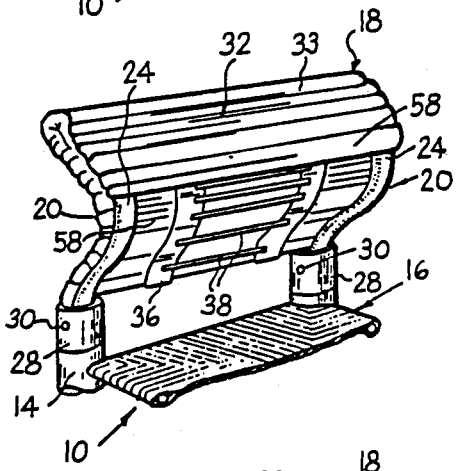
Figure 11:
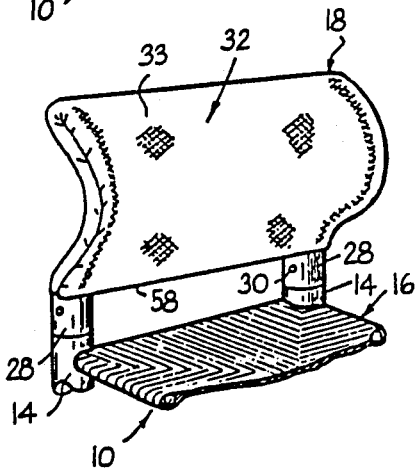

Preferably, the sheet of upholstery material 32 is in a single piece which is attached to the seat back upright posts 20 as illustrated schematically and sequentially at FIGS. 9–11. A length of upholstery material 32 is cut which is substantially equal to the total length of the leg or branch 24 and the leg of branch 26 of the upright posts 20. The length of upholstery material 32 is stretched, for example, over the back of the rear legs 26 of the posts 20, FIG. 9, the material being twice the length eventually finally required for forming the back 18 being pleated, as shown, such as to absorb the excess length, and the edges of the sheet of upholsterial material 32 provided with the hems 36 being interconnectd by means of the connecting tension members 38. Once the connection between the hemmed edges is completed, the general appearance of the lengths of upholstery material 32 is that of an accordion-like sleeve disposed over and between the rear legs or branches 26 of the upright posts 20. The upper edge 58 of the sleeve is pulled over the bent portion 22 interconnecting each rear leg or branch 26 with the corresponding front leg or branch 24 of the upright posts 20 and is pulled down over the front legs 24 of the upright posts 20, FIG. 10, until the edge 58 reaches the bottom of the front legs or branches 24 at the socket connector 28 with the chair rear leg 14, FIG. 11.

It will be readily appreciated that, although the structure of the invention has heretofore been described as an example of structure for a seat back, the same principles are conveniently used for forming chair seats, armrests and other upholstered furniture or portions of furniture by providing support frame members each in the form of a bent-over double member and stretching a length of pliable and/or flexible material between two pairs of such bent-over double frame members, the junction between the edges of the length of material being hidden form sight by being disposed in the space between the front and the rear layers of the sheet of material. There results four layers of load carrying material, with progressive resistance to deformation of the surface layer, which does away with the requirement of providing load supporting springs or compressible stuffing material such as foam rubber or the like.

As previously mentioned, the frame members may be made of any convenient material, such as round or flat tubular members, or round or flat massive rods or strips, the latter preferably with rounded corners. A further example of structural material for forming the frame is illustrated at FIGS. 12–13 as consisting of lengths of cylindrical tubes or rods 60 bent-over such as to form a pair of substantially parallel support legs or branches 62 and 64 integrally joined by a curved portion 66. Prior to bending the rod 62 to the shape illustrated at FIG. 12, a plurality of tubular members or beads generally designated at 68 are disposed around the rod 60. Some of the tubular members or beads 68 have an appreciable length as shown at 70 and are placed end to end over the portions of the rod 60 remaining straight after appropriate bending to shape, or they may consist of a single-piece tubular member 72 of appropriate length covering the whole length of the straight portions of the rod 60 after bending to shape. The beads or tubular member 68 are of relatively short length, as shown at 74 at the portions of the rod 60 in each leg or branch 62 and 64 which are subject to a bend, and at the curved portion 66 joining the legs or branches 62 and 64. Once the upholstered material is stretched over and supported by the frame legs or branches 62 and 64, the beads or tubular members 68 act as bearings allowing the sheet of upholstery material to roll rather than slide back and forth when further stretched under load and when the load is removed with considerably reduced friction, thus enabling unhibited stretching and unstretching and considerably reducing wear of the material.where attached to the support frame members.

It will be appreciated that although the support frame members, according to the present invention, are in pairs and are preferably substantially mutually parallel, which is the preferred structure for providing progressive load absorption by way of four plys or layers of upholstery material sequentially engageable and elastically deformable, the U-shaped structural frame member's branches need not be absolutely parallel, as shown at 120 at FIG. 14 relative to the back 118 of the chair 100. In the structure of FIG. 14, the tension members interconnecting the edges of the upholstery material 32 are still hidden from sight, and the consecutive layers of upholstery material are sequentially engageable as heretofore explained in detail, in relation with the top and bottom portions of the chair back 118, while the center of the chair back is substantially less firm than the top and bottom thereof, in view of the greater distance separating the front layer 133 of upholstery material 32 from the rear layer at the center of the back 118. The seat 116 of the chair 100 is constructed preferably in the same manner as the back 118, the support frame members, 120' for the seat 116 being disposed substantially parallel to each other and in close proximity with each other.

The invention may be used for a plurality of diverse styles of chairs and other furniture, examples of which are illustrated at FIGS. 15–21. FIG. 15 illustrates a chair 200 provided with a seat 216 and a back 218 upholstered according to the present invention. The frame of the chair 200 is made of a pair of lateral frame members 220 held spaced apart by means of laterally extending cross-members 222 and 224. Each lateral frame member 220 is formed of a single loop of flat metallic strip bent in such manner as to form a pair of closely spaced-apart parallel frame members 228 and 230 bent over at the top 232 of the back 218 and at the rear 235 of the seat 216. As shown, the two lateral frame members 228 and 230 thus form a generally upright double post 236 and generally horizontally disposed seat double frame 238 between which a fold-over double layer of upholstery material 32 is attached such as to form between the lateral frame member 220 the back 218 and the seat 216 of the chair 200. After bending to the shape illustrated to form the lateral frame member 220, the ends of the flat strip 226 are butt-welded.

A hassock 300, of the same style and of similar structure is illustrated at FIG. 16 made of a pair of parallel lateral double frame members 320 held spaced-apart and laterally extending cross-members 322 and 324. The load supporting seat 316 of the hassock 300 takes the form of two separate portions of upholstery material, namely a top layer 326 and a bottom layer 328 which, in view of the particular sturcture of the hassock 300, are made of separate lengths of upholstery material 32 with the tension members connecting the edges of the upholstery material being disposed between the top layer 326 and the bottom layer 328, such as to be hidden from sight.

FIG. 17 illustrates another example of chair 400 having a seat 416 a back 418 made according to the present invention. The frame of the chair 400 consists of a pair of spaced-apart lateral frame members 420 maintained at an appropriate distance from each other by means of a transverse beam member 422 welded, brazed or otherwise fastened at each end to one of the lateral frame members 420. Each lateral frame member 420 takes the form of a length of flat iron or other metallic strip 430 bent as is readily apparent from the drawing such as to form a bottom seat support member, a top seat support member, disposed substantially parallel to the bottom seat support member, continuing into a back top support member bent-over at the edge of the back 418 and extending substantially parallel to the back top support member such as to define the back rear support member down to the portion adjoining the seat bottom support member. The ends of each length of flat iron or other material strip 430 defining a lateral frame member 420 are bent over in opposite directions to form a pair of feet 434 in engagement with the ground. To increase the rigidity of the chair frame, the lateral frame members 420 may be interconnected by a laterally extending reinforcing member, not shown, for example at the top of the back 418. A single length of upholstery material 32 is used, stretched between the two separate and generally substantially parallel lateral frame members 420, the edges of the sheet of upholstery material 32 being interconnected by appropirate tension members, as previously explained, or in the alternative, the sheet of upholstery material 32 being made in the form of a sleeve, as shown at FIG. 8.

FIG. 18 illustrates another example of furniture in which the present invention may be used for forming the headboard 518 and the footboard 540 of a bed 500. The headboard 518 and the footboard 540 are each made of spaced-apart U-shaped frame members 520 upholstered on the front and rear with a sheet of upholstery material 32 affixed as hereinbefore explained in detail, the lateral frame members 520 of the headboard 518 and footbard 540 being held spaced-apart by appropriate cross-members, not shown, in turn attached to the frame of the bed itself.

Figure 19:
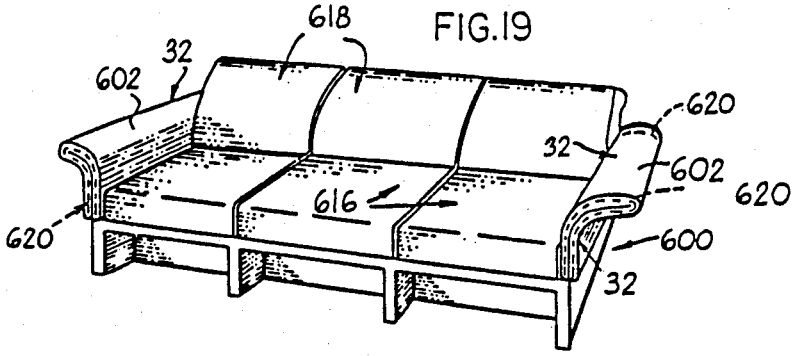

FIG. 19 illustrates a sofa 600 having armrest 602 made of two spaced-apart frame members 620, each frame member 620 being substantially U-shaped and bent to and appropriate contour such as to form two substantially parallel bifurcated legs. A single sheet of upholstery material 32 is stretched and attached between the pairs of spaced-apart frame members 620 defining the front and rear ends of the armrest 602. If so desired, the seats 616 of the sofa 600 and the backs 618 may be made according to the teachings of the present invention.

Figure 20:
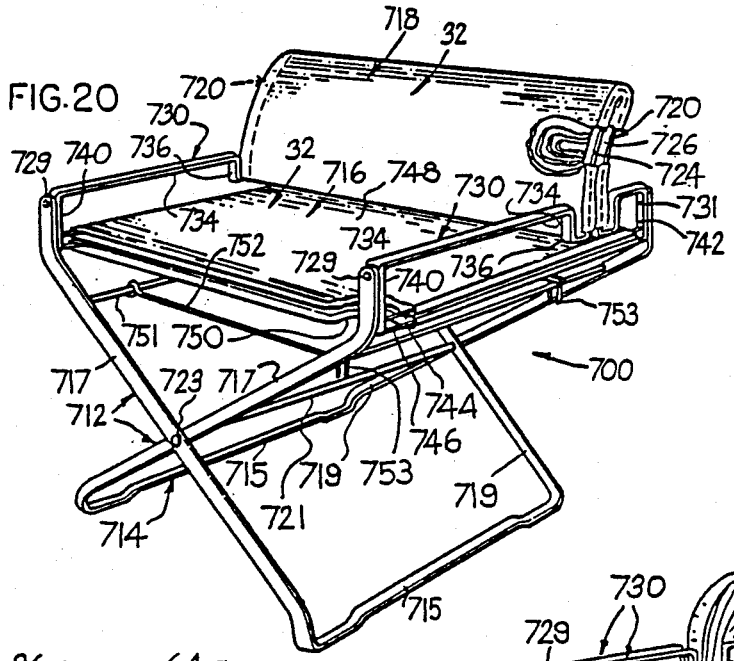
Figure 21:
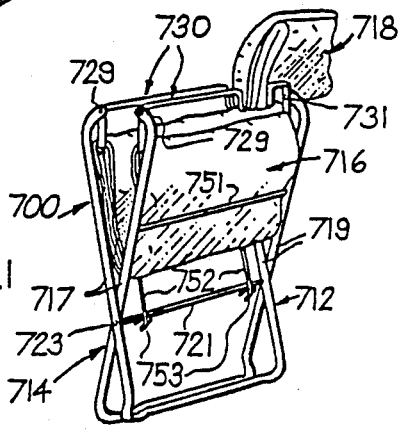

A further example of application of the present invention that presents particular advantages consists of the foldable chair 700 provided with a seat 716 and a back 718 made according to the teachings of the present invention, the foldable chair 700 being shown erected at FIG. 20 and folded at FIG. 21. The foldable chair 700 is generally of the form and of the structure as that disclosed in an application for Lever Action Foldable Chair, U.S. Ser. No. 152,440, filed May 22, 1980 by one of co-applicants herein, said patent application filed on May 22, 1980 comprising backrest and seat made of one layer of upholstery material held by friction and not four plys of upholstery material held by the teaching of the methods of the present invention.

The foldable chair 700 comprises a pair of generally U-shaped leg support frames 712 defining a ground supported structure 714. Each leg frame 712 is made of a length of flat bar material, metallic or plastic, which is bent in the form of a three-sided square or rectangle such as to define the bottom of foot portion 715 integrally joined to substantially parallel front leg 717 and rear leg 719. One leg frame 712 is pivotally fastened to the other leg frame 712, such that the plane of one leg frame intersects the plane of the other leg frame along a pivot line, the front legs 717 and the rear legs 719 being pivotally fastened to the other leg frame 712 or, in the alternative, a pivot rod 721, as illustrated, being used for pivotally fastening the two leg frames 712 together, each end of the pivot rod being provided with a flat head 723, such that the front legs 717 and the rear legs 719 of each U-shaped leg frame 712 are relatively pivotable in a scissor-like fashion, the pivot rod 721 increasing the rigidity of the ground supported structure 714.

The upper free end of each front leg 717 and rear leg 719 is pivotally attached by means of a bolt or rivet 729 and 731, respectively, to an armrest structure 730. Each armrest structure 730 comprises an upper member 734 extending rearwardly and bent-over downwardly proximate its rear end such as to form a generally U-shaped recessed portion 736. A generally U-shaped post member 720 is attached at its free ends to an armrest recessed portion 736, the post member 720 being made of a single length of, for example, flat bar material forming a pair of substantially parallel frame members 724 and 726, a single sheet of upholstery material 32, forming the back 718, being attached to opposite post 720, in the same manner as hereinbefore described. Alternatively, the posts 720 may be made integral with the armrest structure upper member 734 bent over upwardly such as to define the front frame member 724 of the post 720 and bent up itself such as to define the top of the post members 720 followed by the rear member 726 of the post members 720.

The armrest structure 730 is generally formed as a rectangular frame with an integrally descending front leg portion 740 and rear leg portion 742, the second longest side of the rectangular frame being formed, preferably by a pair of parallely disposed slightly spaced-apart longitudinally extending side rail members 744 and 746 disposed at the bottom of the vertical portion 740 and 742 defining the smallest side of the rectangular frame of the arm rest 730. A length of upholstery material 32 is stretched between and folded over opposite side rail members 744 to form the top surface 748 of the chair seat 716, and a second length of upholstery material 32 is stretched between and folded over opposite side rail members 746 to form the bottom surface 750 of the seat 716, the end edges of the lengths of upholstery material 32 being appropriately interconnected by tension members, not shown, in the space between the top and bottom surfaces 748 and 750 of the seat 716. The seat 716 is thus a four-ply or four layer seat.

The folding chair 700 of FIG. 20 needs no abutments or pins between the front legs 717 and rear legs 719 or between the U-shaped frames 712 for standing erected as illustrated at FIG. 20, the seat 716 forming a pliable highly elastic surface for supporting the buttocks of a person sitting in the chair, each armrest frame structure 730 defining each a lever pivoting around the pivot formed by the rivets or bolts 729 and 731, the seat remaining in body supporting equilibrium as a result of the weight applied on the seat 716 and on the back 718. The leverage is such that a heavy load applied upon the seat 716 tends to spread the top of the posts 720 away from each other which causes the four plys of the sheet of upholstery material 32 forming the back 718 to be further tensioned, thus tending to pivot the top of the posts 720 back towards their original position, such tendency being further increased by the pressure applied by the back of the person sitting in the chair against the chair back 718. As a result, the weight of a person sitting in the chair 700 is all that is required for holding the chair erected, and the chair may be easily folded, as illustrated at FIG. 21, for storage or for transportation.

In structures where it is desired to limit the opening or closing of the scissors-action of the leg frames 712, an additional rod, as shown at 751, is disposed in each leg frame 712 for joining the front leg 717 to the rear leg 719 proximate the top of each leg frame, and pivotable laterally extending rigid tension-compression members 752 each having a hook 753 at an end, may be provided for interconnecting the rods 751.

Figure 23:
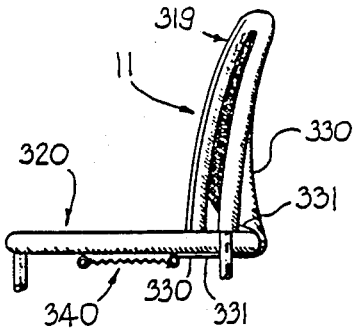
FIG. 23 is a partial side view of the chair in FIG. 22 showing the upholstery material of the back attached under the seat.
Figure 22:
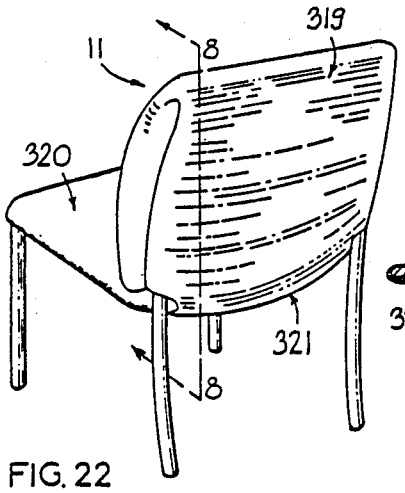
FIG. 22 is a perspective view of a chair having a back structure according to the present invention wherein the upholstery material of the back is pulled down under the seat.
Figure 24:
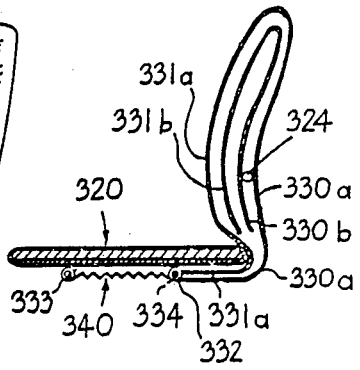
FIG. 24 is a sectional view from line 8—8 of FIG. 22.

FIGS. 22 to 24 illustrate a back having the bottom end prolongation of its front and back surfaces made of upholstery material 330 and 331 tucked under the seat 320. The pliable upholstery material of the surface 330 and of the surface 331 is pulled down such as to stretch the upholstery material of the front surface 331*a* and of the back surface 330*a* in a downward direction; and the prolongation of the upholstery material of these surfaces is folded at 321, over and around the seat back portion of the seat 320, to extend under the seat 320 and to connect to the tension members 340 by the means of rings 332, inserted in the hem of the upholstery material at the edge of the prolongations, and hooks 334 located at one extremity of tensed springs 340 connected at their other extremities to eyescrews 333 connected to the seat structure. The downward tension on the upholstered material of both front and back surfaces removes, by stretching completely the upholstery material vertically, and pleats remaining on the front and back surfaces after a horizontal tension has been applied.

FIG. 25*a* illustrates a simple form consisting of a single sleeve 64 of upholstery material 32, which is fitted over the front legs or branches 24 and rear legs or branches 26 of the upright post members 20. The sleeve 64 can have the shape of a bag which is slipped over the two upright post members 20 by their U-shaped bifurcated free extremities, for example, in the case of the chair of FIG. 1, draping the upright post members 20 completely such as to leave an excess portion or gusset 68 of the sleeve toward the exterior side of each post member. The gusset 68 is then tucked in between the branches 24 and 26 of each post member 20 and forms the two intermediary layers 35.

FIG. 25*b* shows another embodiment of the tension means. In this embodiment, the sleeve 64*a* has tucked-in gusseted portion 68*a*. An inflatable tube 60*a* is inserted within the fold of the gusseted portion 68*a* and, on expansion, will provide tension on the surfaces 33*a* and 39*a* of the sleeve 64*a*. The inflatable tubes 60*a*, which can be replaced by any other expandable bead, replaces the tension spring 60 in FIG. 25*a*.

Figures 26A, 26B, 26C, 26D:
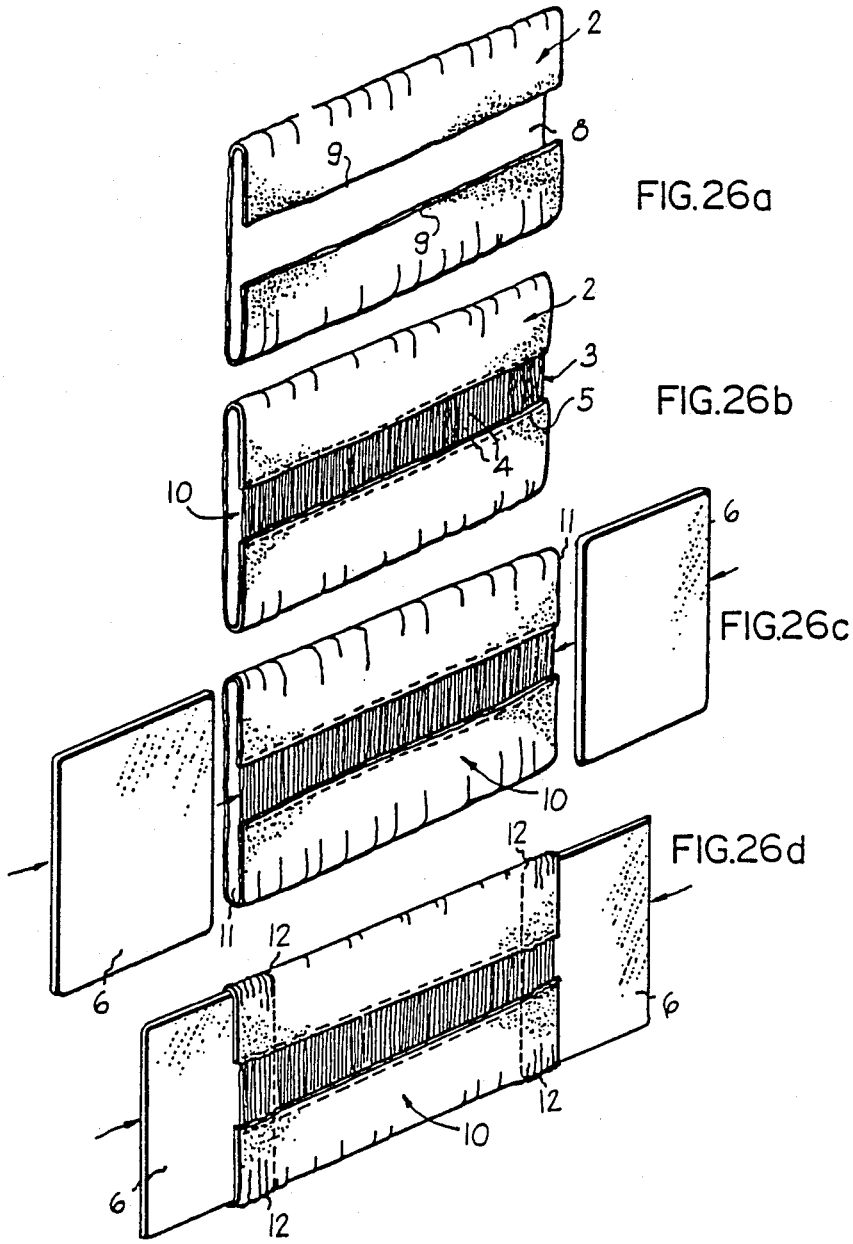
Figure 26E:
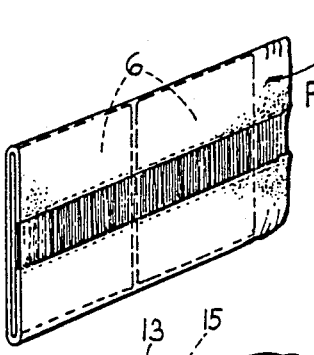
Figure 26F:
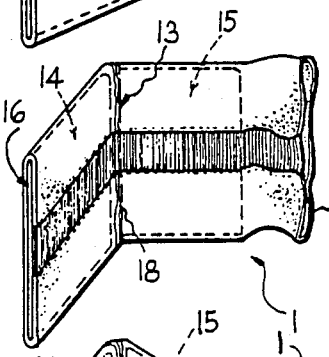
Figure 26G:
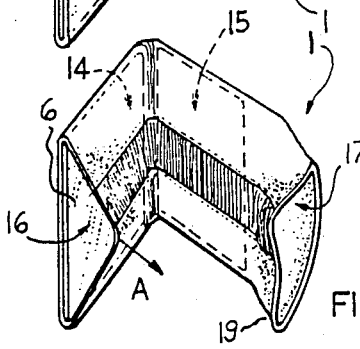
Figures 27, 28:
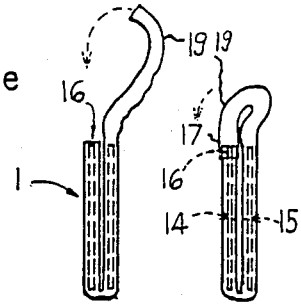
Figure 29:
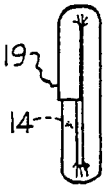

Referring now to FIGS. 26*a* through 26*g*, the sheath structure of the present invention is illustrated as it is applied to a non-furniture construction, such as, for instance, a wallet. In this embodiment, an envelope is formed including flexible sheet material 2 having its longitudinal edges folded as shown in FIG. 26*a*, presenting two parallel edges 9. An elastic band 3 is sewn to each edge 9 at 5. A sleeve 10 is thus formed wherein the elastic yarn 4 of the elastic band 3 extends generally perpendicular to the axis of the sleeve 10. Frame members in the form of lightweight plates 6 having dimensions which are greater than the width of the sleeve 10 are inserted in the so-formed sleeve, such that the sheet material 2 is stretched over the soformed frames. Thus, a sheath structure, as illustrated in FIG. 26*e*, is formed which can be utilized as a wallet which folds on itself, thereby providing the intermediate space between the frames 6. Expandable pockets 14 and 15 are thus formed whereby articles can be inserted through the openings 16 and 17.

Figure 30:
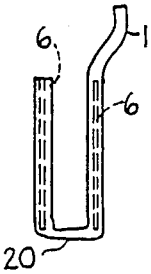
Figure 31:
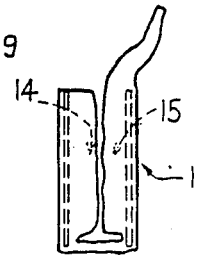

As can be seen from FIGS. 27 through 31, the extension 19 of the sleeve 10 which is free of the plate 6, can be inserted over the other end of the sleeve represented by the opening 16 such as to close the wallet or envelope. FIGS. 30 and 31 show how the wallet can itself be expanded merely by moving the frame members 6 which are not connected. FIG. 31 illustrates the wallet with the expandable pockets filled with articles.

The illustration of a wallet as seen in FIG. 32 includes added pockets 22 and 24 which are sewn or otherwise connected to the sleeve 10. These pockets, as shown, partially cover the elastic band 3.

FIG. 33 illustrates an application of the present invention, particulary the envelope or sleeve 10, as illustrated in FIG. 26, being applied as a book cover. The book cover 29 would have the same structure as the envelope 10, that is, including the frame members 6. The ends 19' and 19" would extend beyond the frames, and since the sleeve is stretchable, would easily fit over the ends of a book cover 27 and 28.

Figure 36:
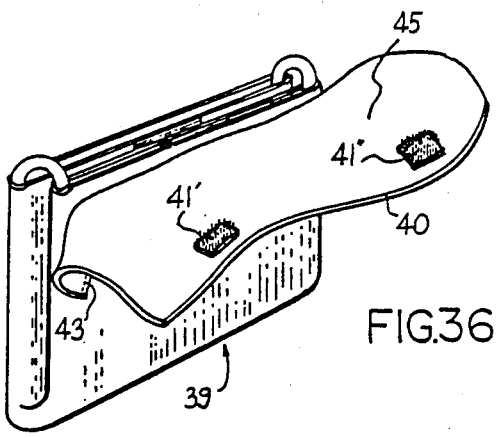
Figure 37:
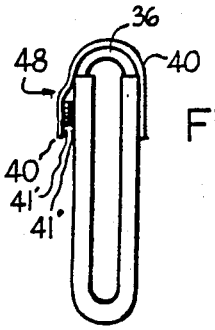
Figure 38:
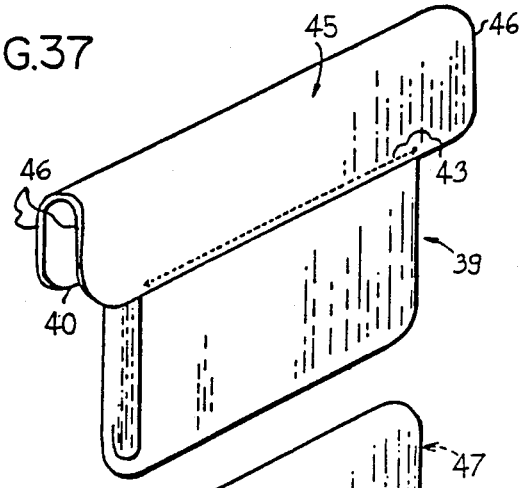
Figure 39:
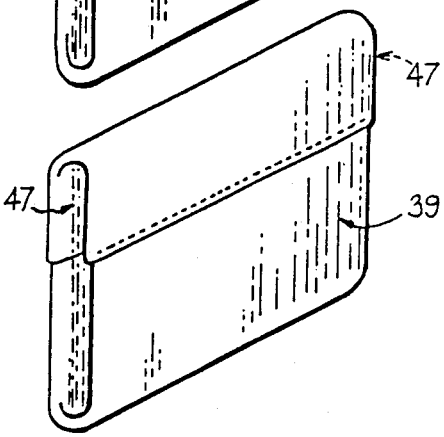

Referring now to FIGS. 34 through 39, there is shown a purse construction made up of a double frame 31 having frame elements 33 and 34 formed of a continuous member bent at 35 and 36. The frame elements 33 and 34 are inserted in a sleeve 32 which, of course, is of similar construction to that described in FIGS. 26*a* and *b*. After insertion of the frame 31, the purse structure is as illustrated in FIG. 36. A closure flap 45 is sewn at 43 to one edge of the sleeve and is adapted to fold over and close the openings formed by the sleeve on the double frame 31, as shown in FIG. 36. VELCRO (registered trade mark) fasteners may be provided at 41' and 41" to engage mating fasteners 44' on the other surface of the sleeve, as shown in FIG. 37. Once the cover is folded over, the end edges 46 may be tucked in into the intermediate space formed between the frame elements 33 and 34.

A carrying bag 50 may be fabricated, as shown in FIGS. 40 to 42. The carrying bag 50 includes a sleeve 52 constructed in accordance with FIGS. 26*a* and 26*b*, which passes over a double frame 51 having frame elements 53 and 54 and similar to the frame 31 in FIG. 34, with the exception that the bight portions of the frame are at 58 and 57 respectively in order to provide carrying handles.

The sleeve 52 is passed onto the frame 51, as illustrated in FIGS. 40 to 42, and assumes a final position, as shown in FIG. 42. Articles can be inserted into the openings formed at the ends of the sleeve, as illustrated in FIG. 42.

Referring now to FIGS. 43 through 47, there is illustrated another embodiment of a chair having a backrest constructed in accordance with the present invention. As will be seen from the description which will follow herein, the backrest includes a conventional backrest frame on a chair to which is added a sleeve including a plate member forming the second frame element which will be folded over onto the frame element formed by the frame of the back of the chair.

Referring now to FIGS. 43 and 44, there is shown a chair 1 having front legs 8 and rear legs 9, the rear legs 9 extending upwardly to form a backrest frame 4. The sheath structure 3 forms the backrest, as shown in FIG. 43, and is made up of a sleeve 10 having a front surface 20 which is folded over at 11 to form the rear surface 21. The tucked-in portions of the side of the sheet material forming the sleeve 10 are folded over the frames at 22. As will be seen, the excess material from the bottom of the sleeve is tucked into the intermediate space from the bottom at 23. As can be seen in FIG. 43, the backrest is formed of a fabric material having no visible seams. Furthermore, the fabric material forming the backrest is under tension, and the tension elements are completely hidden from view.

In FIG. 44, the backrest frame element 4 includes vertical extensions 7 of the legs 9 and horizontal cross-members 5 and 6.

FIG. 45 illustrates the sleeve 10 to be applied to the backrest. In this case, the sleeve includes a flexible material, such as woven or knitted fabric, having longitudinal edges 15 and 16 which are folded over. The edges 15 and 16 extend parallel to each other and are spaced apart. Elastic bands 31 extend between the edges 15 and 16 and are sewn to the edges of the sleeve, as shown in FIG. 45. These flaps include eyelets 19 along the edge thereof.

As shown in FIG. 46*a*, the sleeve 10 having a width smaller than the width of the frame 4 is inserted under tension over the frame 4. The lower flap 17 is folded upwardly around the cross-bar 6. Tension members, such as elongated spring members 41, are connected or hooked through the eyelets 19 on the flap 17 and to the cross-bar 5 which is exposed in the area of the opening formed by the edges 15 and 16 of the sleeve. This is illustrated in FIG. 46*b*.

A lightweight rigid plate member 50 is inserted in the other end of the sleeve, as shown in FIG. 46*b*, and the flap 18 is folded over the end of the plate member 50 in a manner shown in FIG. 46*c*. Tension members, such as elongated springs 41, are hooked in the eyelets 19 on the flap 18, as shown in this Figure, and to the cross-bar 5. Rings 42 can be provided on the cross-bar 5 for hooking the springs 41. The portion of the sleeve including the plate 50 is then folded over at 60 onto the backrest frame 4 and may be fastened to the flap 17 by means of VELCRO strips 70*f* and 70*m* as shown in FIG. 46*c*. The completed backrest is as shown in FIG. 43 as well as in FIG. 47 which is a cross-sectional view of the backrest of FIG. 43. It is evident that padding could also be inserted over the plate member 50 within the sleeve 10 for the purpose of presenting a more comfortable backrest.

A further embodiment of a chair in accordance with the present invention is illustrated in FIGS. 48 through 58. In these drawings, the chair has a backrest frame 103 and includes a rigid plate 1104 extending between members 173 of the front frame element 104 and the back frame element 140. The rigid plate is curved and bends about the top of the backrest at 185, as shown in FIG. 48. The backrest double frame 104 and 140, formed by U-shaped extensions of the legs 109, provide members 173 and 175. The ends of the U-shaped frames are attached to the seat at 178 and 179. Support members 174 are also provided in the backrest frame structure.

FIG. 54 is a cross-section which shows the shape of the plate 1104 as part of the frame elements 104 and 140. The plate member 1104 is covered by padding 171, as shown in FIG. 56 and in FIG. 50. The padding 171 can be either fixed to the plates by means of adhesive or can be removable.

Figure 51:
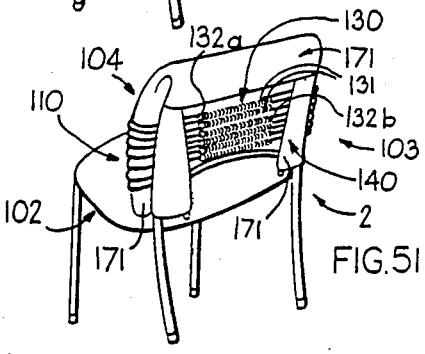
Figure 52:
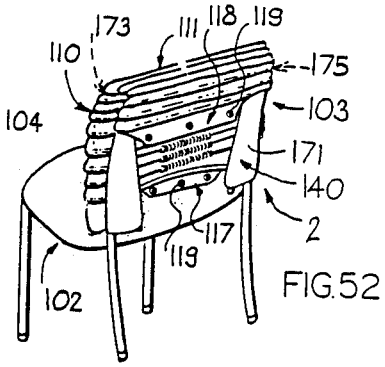
Figure 53:
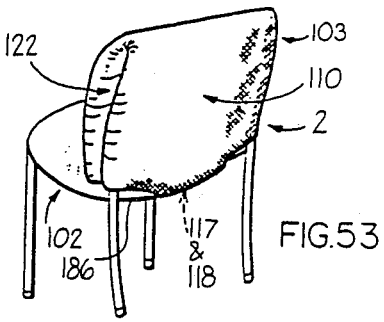
Figures 61A, 61B, 61C, 61D:
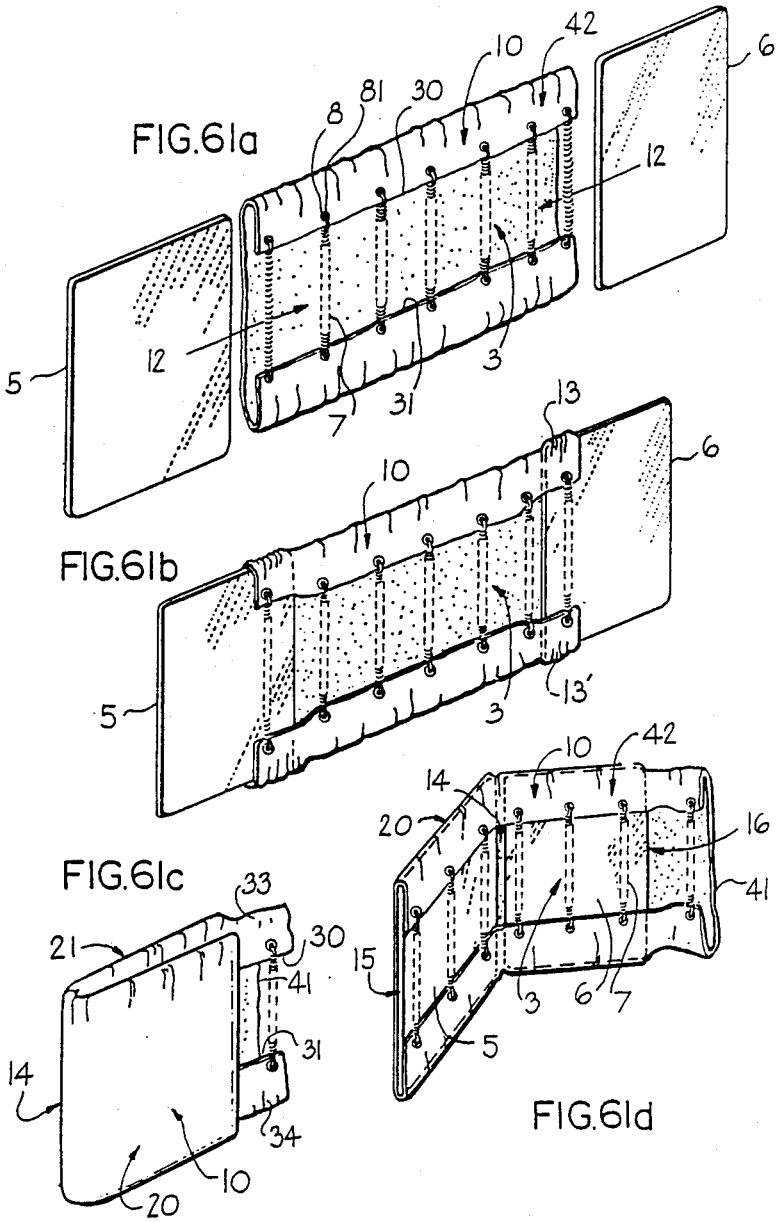

A sleeve 110 is then passed onto the frame elements 104 and 140 by first wrapping the sheet material of the sleeve about the frame element 104 and attaching the spring elements represented by the number 130 in FIG. 51. Once all the spring elements 131 of the tension system 130 have been attached to the edges of the sheet material to form the sleeve, it is passed over and extended to the full extent of the double frame, that is, frame elements 104 and 140, as shown in FIGS. 52 and 53. An end flap 118 having eyelets 119 is provided on one end of the sleeve as a flap 117 with eyelets 119 as provided on the other end. The flaps 117 and 118 are fixed as in the manner shown in FIG. 56. In this case, the flaps are passed under the seat 102 and attached to spring members 141 anchored at 142 and provided with rings 120 passing through the eyelets 119.

The cross-sectional view of FIG. 57 illustrates the sleeve 110 passing over the plate 1104 and the padding 171.

The sleeve can be installed in various manners whereby it can be wrapped laterally around the frame elements 104 and 140, as shown in FIG. 58. The pressure of the padding against the tucked-in ends of the sleeve 110 can provide the necessary tension to keep the sheet material under tension. Other conventional ways of holding the tucked-in ends of the sheet material can also be provided.

FIGS. 59 and 60 illustrate yet another embodiment of the chair shown in FIG. 43, wherein the backrest includes a pair of fixed plates 141 and 151 with a foam-type padding 71 on the fixed plates 141 and 151. The fabric forming the sheath 10 is stretched on the frame elements 141 and 151, thereby compressing the foam padding and anchored at 170 and 172, thereby maintaining tension on the fabric. The installation of the sleeve 10 is essentially the same as that described in relation to the embodiment shown in FIG. 43.

Another application of the present invention is in relation to panels which can be used either as support members for furniture, lamp structures, or as dividers or screens in offices. FIGS. 61*a* through 61*d* represent the installation and construction of a panel. The sequence of construction is very similar to that described in relation to the embodiment shown in FIGS. 26*a* to 26*g*. Accordingly, the sheath structure may only be described briefly. As shown in these drawings which show a sequential assembly, there is provided a sleeve 10 with a tension system 3 including springs 7 hooked to eyelets 81 in the end edges 30 and 31 of the fabric material forming the sleeve 10. Frame elements in the form of plates 5 and 6 are inserted in the sleeve 10, whereby the material is held on the frame elements under tension. Various means of closing the panels are illustrated in FIGS. 62 and 63. In the illustration shown in FIG. 62, the ends of the sleeve 177 are folded inwardly and can be retained in one of the attachment systems shown in FIGS. 64*a, b* and *d*. The other end which is folded over might be represented by the section shown in FIG. 64*c*.

The panel shown in FIG. 63 has both ends thereof tucked in at 22 and 18. Once again, the tension system can be of the type shown in FIGS. 64*a*, 64*b*, and 64*d*.

FIG. 65 shows how a screen can be set up while FIGS. 66 and 67 show the disassembled screen. Under final installations, these screens or panels would have the appearance of FIGS. 65, 68, 69, or 71.

FIG. 70 shows the use of the folded-over panel as a stand for a coffee table.

The embodiments of the invention in which an exclusive property or privilege is claimed are defined as follows:

1. A sheath structure having a front panel and a rear panel, said panels being coextensive and spaced apart to define an intermediate space therebetween, each panel including a pair of spaced-apart side frame edges; a single pliable sheet material stretched over the side frame edges of the respective front and rear panels, with portions of the sheet material being tucked in between said respective side frame edges within the intermediate space so as not to be visible, and tension means within the intermediate space attached to respective tucked in portions of the sheet material thereby stretching the sheet material.

2. A sheath structure as defined in claim 1, wherein each front and rear panel includes a frame member defining the side frame edges over which the pliable sheet material is stretched.

3. A sheath structure as defined in claim 2, wherein the pliable sheet material overlying the front and rear panels is a one-piece sheet folded over another frame edge.

4. A sheath structure as defined in claim 3, wherein the pliable sheet material has side edges tucked within the intermediate space, thus providing four distinct side edges within the intermediate space, and tension members extend between respective pairs of the side edges so provided.

5. A sheath structure as defined in claim 1, wherein the pliable sheet material is in the form of a one-piece sleeve having gusseted sides, the gusseted sides being tucked in at side frame edges within the intermediate space and the tension members cooperate with the tucked-in gusseted sides for providing tension on the sheet material.

6. A sheath structure as defined in claim 3, wherein the pliable sheet material is in the form of a sleeve made of an extensible fabric, and the sleeve includes a seam made up of fastening means between the edges of the sheet material forming the sleeve, wherein the seam is the tension means and is hidden within the intermediate space.

7. A chair comprising a backrest made up of sheath structure as defined in claim 1, wherein the backrest frame forms the side frame edges of the respective front and rear panels and the chair includes two spaced-apart pairs of upstanding frame members, a corresponding one frame member of each pair forming the front side frame edges of the front panel, the other frame member of each pair forming the side frame edges of the rear panel and each pair defining an intermediate space therebetween such that the pliable sheet material is tucked in within the pairs of the backrest frame members so that the front panel of the sheath structure represents the front backrest panel.

8. A chair as defined in claim 7, wherein each pair of frame members is in the form of a U-shaped rigid member extending upwardly from a rear corner of the chair.

9. A chair comprising a sheath structure as defined in claim 1, wherein separate sheath structures form the seat and backrest respectively.

10. A bed comprising a sheath structure in accordance with claim 1 as a headboard and footboard thereof.

11. A sofa, armchair or the like, comprising a sheath structure in accordance with claim 1 as the armrest thereof.

12. A foldable chair comprising a pair of front leg members hingedly pivotable relative to each other about an intermediate pivot axis in a scissors-like fashion, a pair of rear leg members hingedly pivotable relative to each other about said intermediate pivot axis, said front and rear leg members having an end for engagement with the ground and another end, a pair of pivotable seat supporting and back supporting structures each pivotably attached at said other end of said leg members and each extending between a front leg member and a corresponding rear leg member, means at the bottom of said seat and back supporting structure for attaching below said pivotable attachment of said supporting structure, at least one length of a pliable sheet of upholstery material defining the seat portion of said chair, and the back supporting structure being in the form of a sheath structure in accordance with claim 2, and the back supporting structure comprising frame members forming part of the supporting structure and extending above said pivotable attachment, and said sheath structure on said frame members being held under increased tension as a result of a load being applied to said seat portion.

13. A sheath structure as defined in claim 2 in the form of a backrest wherein a first frame element is provided including said spaced-apart side frame edges, a one-piece sleeve formed of the pliable sheet material and having a pair of parallel opposed edges and forming the rear panel, and the tension means extending between the edges of the sheet material for providing tension on the sheet material when fitted over the first frame member, a second frame element having spaced-apart side frame edges inserted in a portion of the sleeve extending beyond the first frame element and the sleeve portion including the second frame element forms the front panel being foldable over the first frame element in parallel relation therewith and the tension means provides tension on the sheet material over the second frame member.

14. A sheath structure as defined in claim 13, wherein the sleeve includes flaps on each end thereof adapted to be folded over the respective frame members, and tension means are attached to the flaps and to another part of the sheath structure for maintaining the portion of the sleeve including the second frame member secure against the first frame member such that the second frame member within the front panel forms the body supporting surface of the backrest or seat.

15. A chair having a backrest or seat in accordance with claim 13, wherein the rear panel including the first frame member is the permanent backrest or seat frame and the front panel including the second frame and the front panel including the second frame member is in the form of a plate.

16. A sheath structure as defined in claim 13, wherein padding is inserted in the front panel within the sleeve between the second frame member and the pliable sheet material forming the sleeve on the front portion of the backrest or seat.

17. A sheath structure in accordance with claim 15, wherein the second frame member of the rear panel is an integral part of the backrest or seat frame and presents a double frame with the first frame member, and the second frame member is in the form of a plate member curved to the contours of the body anatomy.

18. A sheath structure as defined in claim 16, wherein the tension on the sheet material is provided by the compression of the padding, the padding being resilient, and the tucked-in portions of the sleeve being anchored to the first and second frame member forming the backrest of the chair.

19. A sheath structure as defined in claim 2, in the form of a backrest for a chair, wherein padding is provided on the front panel and within the interior of the sheet material forming the front exterior surface.

20. A sheath structure as defined in claim 19, wherein the tension on the sheet material is provided by the compression of the padding, the padding being resilient, and the tucked-in portion of the sheet material being anchored to the frame members through the intermediate space.

21. A sheath structure as defined in claim 19, wherein tension of the sheath material is provided by the compression of the padding, the padding being resilient, and the tension means being in the form of expandable elongated beads inserted within the tucked-in portions of the sheet material which are in the form of gusset folds tucked in within the intermediate space.

22. A sheath structure as defined in claim 5, wherein the tension members are in the form of expandable elongated beads insertable within the gusseted sides tucked in the intermediate space.

23. A sheath structure as defined in claim 22, wherein the expandable elongated beads are in the form of inflatable tubes which can be inflated to expand once they are inserted within the gusseted sides within the intermediate space for providing tension on the sheet material.

* * * * *